US010549141B2

(12) United States Patent
Hill

(10) Patent No.: US 10,549,141 B2
(45) Date of Patent: Feb. 4, 2020

(54) WEIGHT SYSTEMS FOR EXERCISE EQUIPMENT

(71) Applicant: Progressive Weights, LLC, Newcastle, WA (US)

(72) Inventor: T. Chad Hill, Newcastle, WA (US)

(73) Assignee: Progressive Weights, LLC, Newcastle, WA (US)

( * ) Notice: Subject to any disclaimer, the term of this patent is extended or adjusted under 35 U.S.C. 154(b) by 172 days.

(21) Appl. No.: 15/493,053

(22) Filed: Apr. 20, 2017

(65) Prior Publication Data

US 2017/0304671 A1 Oct. 26, 2017

Related U.S. Application Data

(60) Provisional application No. 62/325,049, filed on Apr. 20, 2016.

(51) Int. Cl.
*A63B 21/072* (2006.01)

(52) U.S. Cl.
CPC ..... *A63B 21/0726* (2013.01)

(58) Field of Classification Search
CPC ..... A63B 21/06; A63B 21/065; A63B 21/072–0726; A63B 21/075
See application file for complete search history.

(56) References Cited

U.S. PATENT DOCUMENTS

2006/0172870 A1* 8/2006 Virji ..... A63B 21/065 482/105
2008/0070760 A1* 3/2008 Daniel ..... A63B 21/0603 482/105

* cited by examiner

*Primary Examiner* — Jennifer M Deichl
(74) *Attorney, Agent, or Firm* — Perkins Coie LLP

(57) ABSTRACT

A weight system can be used with exercise equipment to perform workout routines. The weight system can include dumbbell head covers configured to be removably coupled to the heads of the dumbbell. The head covers can be installed on different sets of dumbbells in a workout routine to provide a customized workout. The head covers can have self-cinching end portions and a tubular central portion for extending over the head of the dumbbell. The self-cinching end portions can cooperate to hold the dumbbell head while performing lifts.

28 Claims, 10 Drawing Sheets

WEIGHT SYSTEMS FOR EXERCISE EQUIPMENT

TECHNICAL FIELD

The present application relates generally to weight systems that can be used with exercise equipment. In particular, several embodiments are directed to weight systems installable on dumbbells, free weights, and/or exercise equipment.

BACKGROUND

Gyms typically have a limited amount of exercise equipment due to equipment costs and limited space. Gyms often have sets of dumbbells in 10- or 5-pound increments. For example, a gym may have a 40 lb. (18.1 kg) pair of dumbbells and the next heavier dumbbells may be a 45 lb. (20.4 kg) pair of dumbbells. This presents disadvantages because it can decrease the rate of weight progression in training routines that require users to slowly increase resistance. Gym users who rely on dumbbells must make significant gains in strength before progressing to heavier dumbbells. This often results in a user hitting a "plateau" where the user is incapable of safely using a heavier dumbbell (or set of dumbbells). When a person attempts to lift too much weight, he or she can often be injured because free weights are often difficult to control. For example, gyms often have 10-pound increments for dumbbell sets heavier than 100 pounds, so a gym may provide a 100 lb. pair of dumbbells, a 110 lb. pair of dumbbells, and a 120 lb. pair of dumbbells. These 10-pound increments may make it difficult for users to gain strength and may result in injuries.

SUMMARY

Some embodiments of the present technology are weight systems that can be applied to conventional exercise equipment. A weight system can include a pair of weight devices manually installable on exercise equipment without altering operation of the exercise equipment. During a workout routine, the weight devices can be applied to different exercise equipment to provide a highly customized workout routine. For example, the weight devices can be installed by wrapping them around ends or heads of dumbbells. In a workout, the weight devices can be used to alter the weight of any number of dumbbells. An elastic grip, compressive forces, and/or narrowed ends can prevent the weight devices from sliding off the heads of the dumbbell. The weight devices can provide an affordable, convenient and complete solution for adjusting the weight of dumbbells without costing the user or the gym substantial amounts of money.

In some embodiments, each weight device is a band, a covering, or a flexible weight that can be installed on a head of a dumbbell. Each dumbbell head can carry a weight device to provide proper weight distribution to perform normal exercise routines, such as dumbbell bench presses, bicep curls, or the like. Advantageously, a user can take the portable weight devices to the gym and apply them to dumbbells to provide increased flexibility for the user's workout, thus providing a large number of dumbbell weight increments. This allows a user to progressively increase the weight of dumbbells to help avoid or reduce, for example, plateauing, becoming injured, or the like.

In certain embodiments, weight devices are in the form of head covers wearable on heads of a dumbbell. The head covers can contract about the heads such that they are securely held in place. In one embodiment, each head cover has a plurality of flexible weight-carrying members spaced apart from one another circumferentially about the heads. The handle of the dumbbell can extend between the heads and can be unobstructed by each head cover.

The head covers can be configured to be installed on a wide range of different types of dumbbells, including polygonal head dumbbells (e.g., hex dumbbells), round head dumbbells, rubberized dumbbells (e.g., dumbbells with plates covered in plastic, solid heads covered in plastic, or the like), or other types of free weights. The head covers can have texturing, friction enhancing elements, positioners, or other features for inhibiting, limiting, or substantially preventing relative movement between the head covers and the dumbbell. In one embodiment, the head covers have an inner surface made of a high friction material for contacting the exterior surface of the dumbbell.

In certain embodiments, a weight system includes a plurality of weighted sections connected by one or more expandable members. In an uninstalled configuration, an internal circumference defined by the weight system is less than an external circumference of the head of a dumbbell. To install the weight system, it is manually expanded to increase its internal circumference to be greater than the outer circumference of the dumbbell head. The expanded weight system can be placed around the dumbbell head and then allowed to contract inwardly against the dumbbell head. In some methods of installation, the weight system can expand to slide over the head of the dumbbell. The installed weight system can be biased inwardly so as to securely hold the dumbbell heads.

In further embodiments, a weight device includes weighted sections and at least one expandable member. The weighted sections are configured to extend between ends of a head of the dumbbell. The expandable member(s) can interconnect the weighted sections such that the weight device is capable of being expanded for placement on the dumbbell head and for pulling the weighted sections against the outside of the dumbbell head when installed. Each of the weighted sections can be sufficiently compliant to conform to the periphery of the dumbbell head. In an embodiment, the weighted sections are spaced apart from one another about the dumbbell head when the weight device is installed. At least one of the weighted sections can have a longitudinal axis generally aligned with or parallel to a longitudinal axis of a dumbbell.

In yet another embodiment, a dumbbell head cover includes at least one weight for overlying a section of a head of the dumbbell when the dumbbell head cover. The dumbbell head cover can include compliant weighted sections for conforming to the shape of the dumbbell head. A set of four dumbbell head covers can be installed on a pair of dumbbells to perform, for example, bench presses (e.g., decline, flat, and/or inclined bench presses), chest flies, military presses, etc. The head covers can be impact resistant to avoid or minimize damage to the dumbbell or head covers themselves. The weighted sections can be spaced apart from one another circumferentially about the dumbbell head. Other configurations and arrangements of weighted sections can also be used.

In some embodiments, a universal weighted head cover is installable on heads of dumbbells. The combined mass of a set of the head covers can be less than the difference in the mass of a dumbbell and the mass of the next heavier dumbbell. In some embodiments, the combined mass of the head covers is equal to or less than 10 $lb_m$, 5 $lb_m$, 2.5 $lb_m$, 1.5 $lb_m$, 1.25 $lb_m$, 1 $lb_m$, or the like. The head covers can have substantially the same mass to balance the dumbbell. In some embodiments, each head cover can have a mass of about 1.25 $lb_m$ for use with dumbbell sets that are available in 5-pound increments. Accordingly, the head covers can be applied to the dumbbells to provide 2.5-pound increments, which may be preferred for progressive training programs. If dumbbells are available in 10-pound increments, the combined weight of the head covers can be 5-pound mass. The same pair of head covers can be repeatedly applied to and removed from dumbbells throughout a workout. Advantageously, conventional lifts can be performed without interference from the head covers because the head covers are positioned well away from the grips of the dumbbells.

Each head cover can include a first self-cinching end portion, a second self-cinching end portion, and a flexible tubular portion. The tubular portion extends between the first and second self-cinching end portions and has sufficient mass for altering weight lifting exercises performed using the dumbbell. The end portions are expandable to remove the head cover from a head of the dumbbell, to reposition the head cover, and/or to install the head cover.

The self-cinching end portions can cooperate to captively hold the head of the dumbbell and can apply an inwardly directed force to keep the head cover generally centered on the head. The cinching allows the head covers to be applied to a wide range of different sized dumbbells. A single set of head covers can be installed on lightweight dumbbells (e.g., 10-lb. dumbbells) to heavy dumbbells (e.g., 120-lb. dumbbells) with heads having round cross sections, polygonal cross sections, or the like. The self-cinching end portions each have an expanded configuration and a contracted configuration. In the expanded configuration, the end portions define openings with expanded diameters larger than diameters of the dumbbell head. In the contracted installed configuration, the end portions define contracted openings with diameters smaller than the diameters of the dumbbell heads. This prevents the head from passing through the narrowed openings. Each self-cinching end portion can include elastic segments coupled together, an elastic band, or the like.

The flexible tubular portion can include weighted sections positionable about the head of the dumbbell. The flexible tubular portion can be configured to extend across most of the length of the head when the self-cinching end portions are cinched on opposite sides of the head and extend inwardly toward a longitudinal axis of the dumbbell for a snug fit. In some embodiments, the flexible tubular portion can include compliant weights configured to withstand impacts when the dumbbell is placed or dropped on a support surface, such as a cement floor, a padded floor, etc. The resilient design of the tubular portion allows the head cover to be used in a wide range of lifts.

DETAILED DESCRIPTION

The present disclosure describes weight training equipment. Several embodiments are directed universal weighted head covers installable on heads of dumbbells. The head covers can be temporarily installed on dumbbell heads with different sizes to customize workout routines. Each head cover can be cinched to ensure that the head cover remains secured to the dumbbell head without affecting use of the dumbbell. Several of the details set forth below are provided to describe the following examples and methods in a manner sufficient to enable a person skilled in the relevant art to practice, make, and use them. Several of the details and advantages described below, however, may not be necessary to practice certain examples and methods of the technology. Additionally, the technology may include other examples and methods that are within the scope of the technology but are not described in detail.

Figure 1:
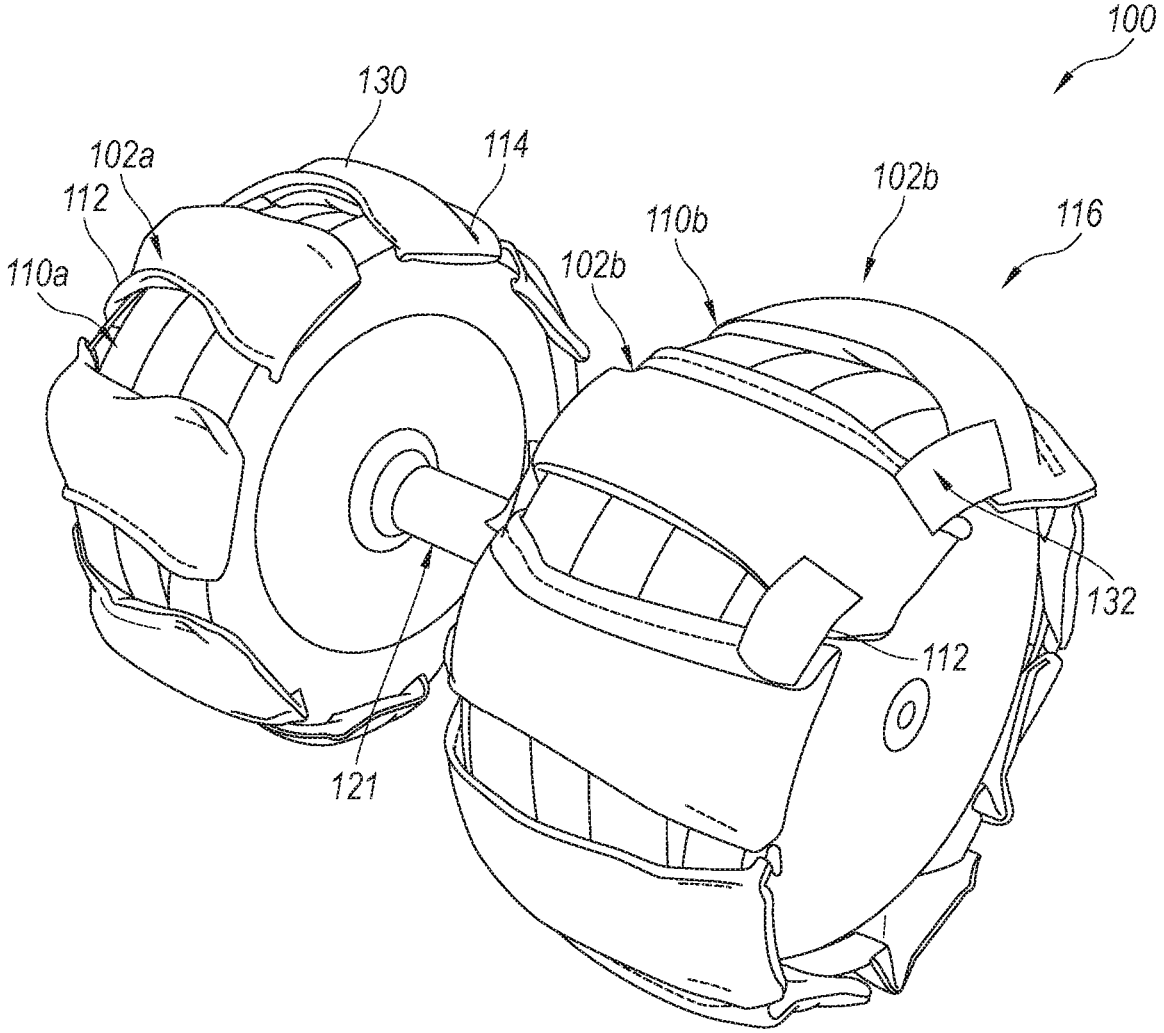
FIG. 1 is an isometric view of a weight system installed on heads of a dumbbell in accordance with an embodiment of the technology.

FIG. 1 is an isometric view of a dumbbell 100 and a weight system including a pair of weight devices in the form of universal weighted head covers 102*a*, 102*b* (collectively, "head covers 102"). The dumbbell 100 includes a handle 121 extending between heads 110*a*, 110*b*. The head covers 102*a*, 102*b* are temporarily mounted on the dumbbell heads 110*a*, 110*b*, respectively, and the combined mass of the head covers 102 can be sufficient to alter weightlifting exercises performed using the dumbbell 100. After performing an exercise, the head covers 102 can be removed and installed on another dumbbell. This allows a pair of head covers to be used to modify the weight of dumbbells to provide the customized workout routine. In some embodiments, the combined weight of the head covers 102*a*, 102*b* can be less than the weight of the next heavier dumbbell to allow microloading in which small increments in weight are used to make strength progression.

Figure 2:
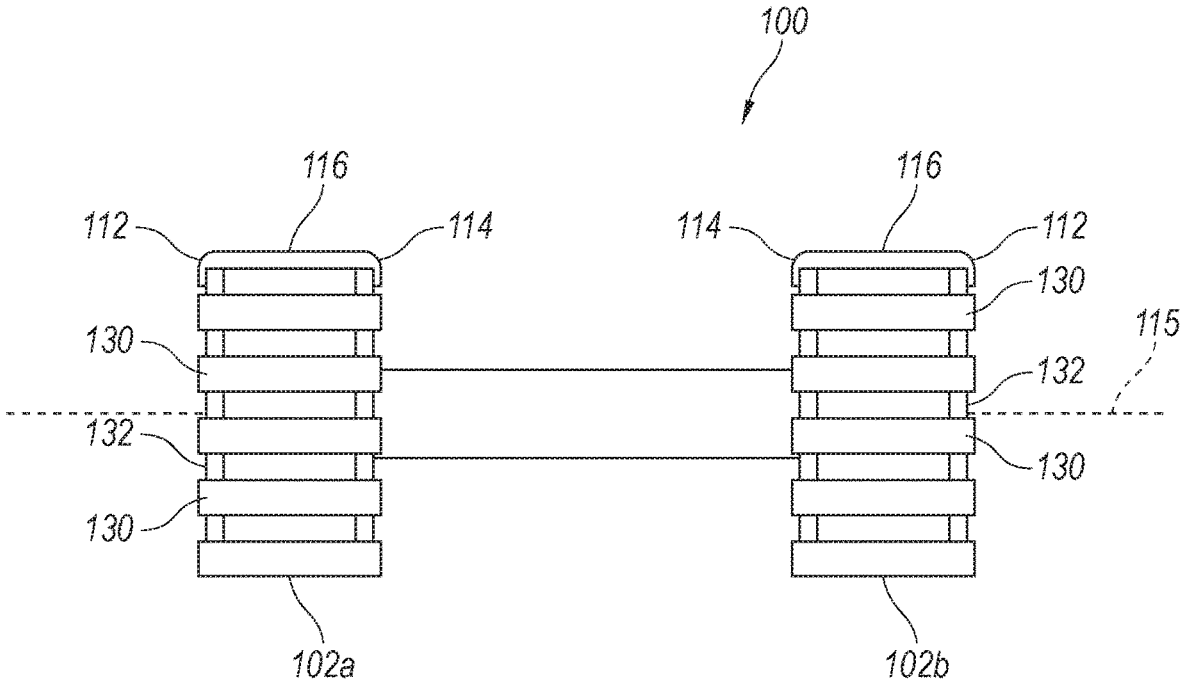
FIG. 2 is a front view of the weight system and dumbbell of FIG. 1.

FIG. 2 is a front view of the head covers 102 and dumbbell 100. The head covers 102*a*, 102*b* can be approximately the same weight to balance the dumbbell. Each head cover 102 can weigh about 1 lb. (0.45 kg), about 1. 25 lbs. (0.6 kg), about 2.5 lbs. (1.1 kg), about 3 lbs. (1.4 kg), about 4 lbs. (1.8 kg), about 5 lbs. (2.3 kg), about 10 lbs. (4.5 kg), or the like. For example, the combined mass of head covers 102 can be equal to or less than about 2.5 $lb_m$ for use with pairs of dumbbells in 5 $lb_m$ increments, about 5 $lb_m$ for use with pairs of dumbbells in 10 $lb_m$ increments, and so forth. The head covers 102*a*, 102*b* can encircle and constrict inwardly to inhibit, limit, and substantially prevent movement of the head covers 102*a*, 102*b* with respect to the respective heads 110*a*, 110*b*. This snug fit allows the dumbbell 100 to be used in normal workout routines. The head covers 102*a* can be expanded outwardly (e.g., manually pulled outward) to remove the head cover 102*a* from the head 110*a*. The head covers 102*a*, 102*b* can be installed on other dumbbells with different size heads. The description of one of the head covers 102*a*, 102*b* applies equally to each other, unless indicated otherwise.

Each head cover 102 can include self-cinching end portions 112, 114 and a flexible tubular body 116. The end portions 112, 114 can cooperate for captively hold a respective head 110 while the tubular body 116 covers the side of the head 110. One or both end portions 112, 114 can be expanded to remove, install, and/or reposition the head cover 102. When installed, the end portions 112, 114 can be biased radially inwardly (e.g., toward a longitudinal axis 115 of the dumbbell 100) to help center the head cover 102 with respect to the dumbbell head 110.

The tubular body 116 can be sufficiently compliant to snugly hold the head 110 while the self-cinching end portions 112, 114 extend along end faces of the head 110. The tubular body 116 can be made of a drapable material that can conform closely to the head shape and can include a plurality of weighted or weight-carrying sections 130 (four identified in FIG. 2) that are interconnected by expandable members 132 (two identified in FIG. 2 and one identified in FIG. 1). The weight-carrying sections 130 can be evenly or unevenly spaced apart from one another about the circumference of the respective head 110. The expandable members 132 can pull the weighted sections 130 toward one another and can be adjacent to or extend along the flat ends of the heads 110*a*, 110*b* such that end portions of the weighted sections 130 extend inwardly along the ends of the heads.

Figure 3:
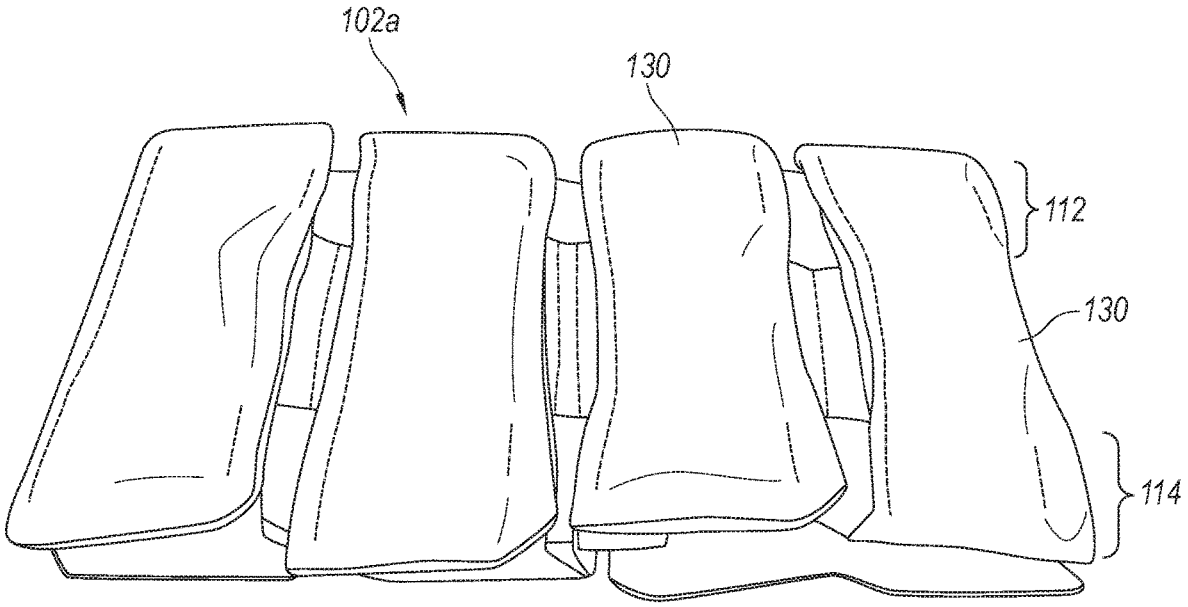
FIG. 3 shows a dumbbell head cover in accordance with an embodiment of the technology.
Figure 4:
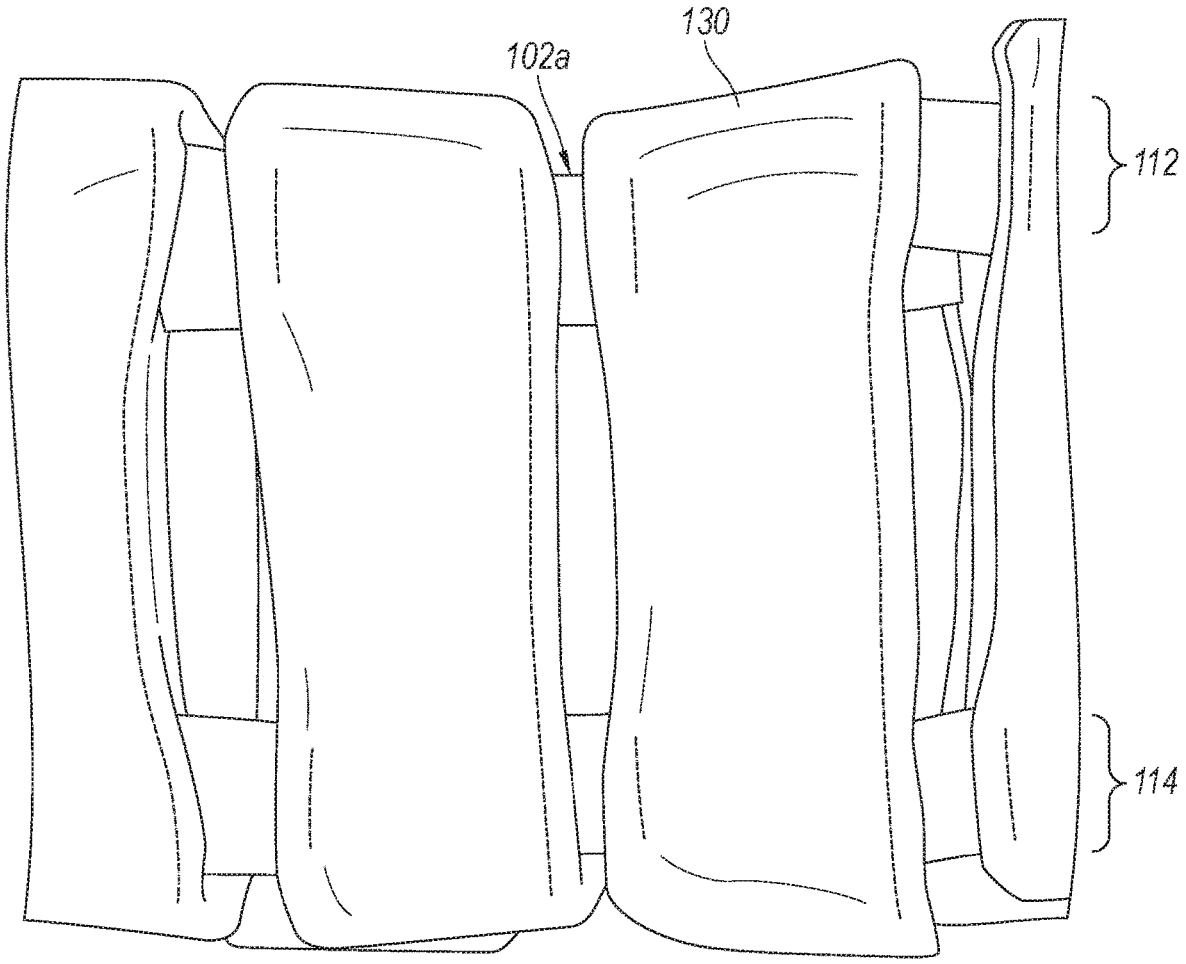
FIG. 4 is a detailed view of a portion of the dumbbell head cover of FIG. 2.

FIG. 3 shows the head cover 102*a* in a generally flat configuration. FIG. 4 shows a section of the head cover 102*a*. The sections 130 can carry, contain, or otherwise have one or more weights and can be sufficiently compliant to avoid breaking if a dumbbell is dropped or impacts a surface. In some embodiments, each weighted section 130 includes a pouch made, in whole or in part, of fabric, leather, neoprene, rubber, or other suitable compliant material. Each pouch can contain one or more weights. Each weight can be a sealed bag or container containing a relatively heavy material, such as sand, iron particles, etc. Other types of elements or containers can be used to hold an impact resistance material (e.g., sand, iron particles, lead balls, etc.). The configuration, mass, and mechanical properties of the sections 130 can be selected based on the workout routines to be performed, configuration of the dumbbells, and auxiliary mass provided by the head covers 102.

FIG. 4 shows the inside of the end portions 112, 114. The end portions 112, 114 can include threading that provides stretchability to hold the pouches and connectors. For example, nylon threads can provide sufficient stretching to avoid damage to the sections 130. The arrangement of connectors and pouches can create a circular band or covering that is biased inwardly to return to its original position. In some embodiments, elastic elements can provide expansion capabilities and can include, without limitation, elastic strips, elastic bands, or other elongatable components.

Figure 5:
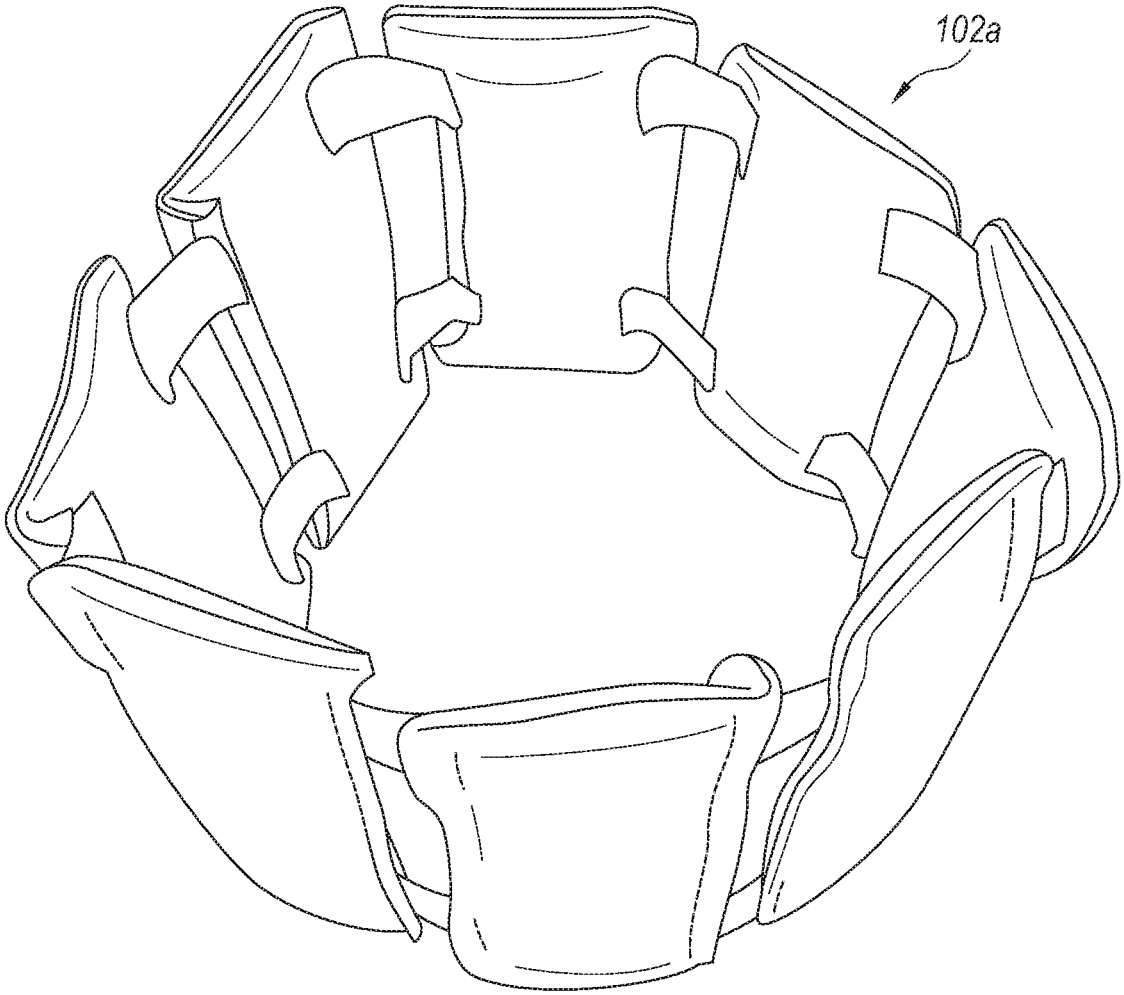
FIG. 5 is a top view of the dumbbell head cover ready to be installed on the head of the dumbbell.

FIG. 5 shows the head cover 102*a* ready to be installed on the head of a dumbbell. The dumbbell head can be inserted into an open end of the head cover 102*a*, and then the head cover 102*a* can be allowed to contract onto the dumbbell head. In other embodiments, the head cover 102*a* can be slid over the dumbbell head such that the dumbbell head causes expansion of the head cover 102*a*. Other types of techniques can be used to manually install the head covers.

Figure 6:
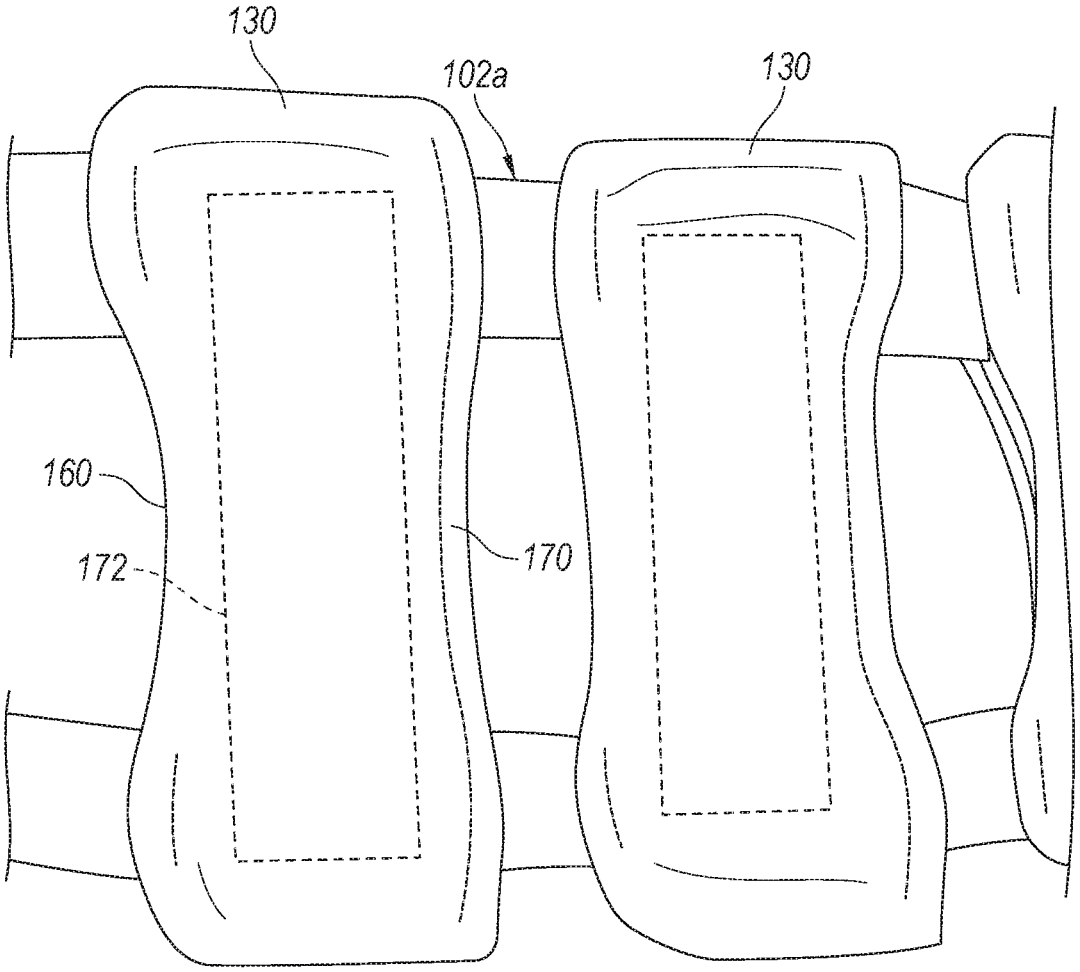
FIG. 6 is a detailed view of a dumbbell head cover in accordance with another embodiment.

FIG. 6 is a detailed view of a weight device in accordance with another embodiment. The weight-carrying sections 130 can have curved sides 160, 170. The sections 130 can also include internal weights 172 (illustrated in dashed line) between the curved sides 160, 170. The size, configuration, and spacing of the weight-carrying sections 130 can be selected based on the desired number of weight carrying sections, total weight of the weight device, and/or other design parameters.

Figure 7:
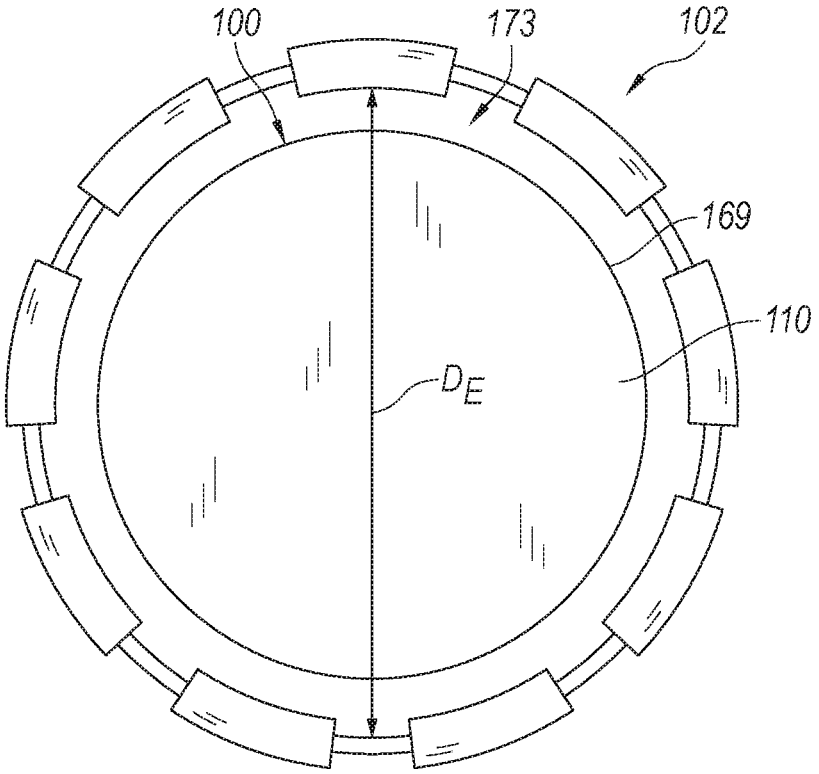
FIG. 7 is a side view of a dumbbell head cover in an expanded configuration for placement on a head of a dumbbell in accordance with one embodiment.

FIG. 7 is a side view of the weight device in an expanded configuration (e.g., a fully expanded configuration) for being placed on a head of a dumbbell in accordance with one embodiment. The head cover 102 can be pulled outwardly to allow the head 110 to pass through an opening 173. Although FIG. 7 shows the head cover 102 in a fully expanded configuration (i.e., radially expanded), the head cover 102 can be installed by pulling one side or opposite sides outwardly past the periphery 169 of the head 110.

Figure 8:
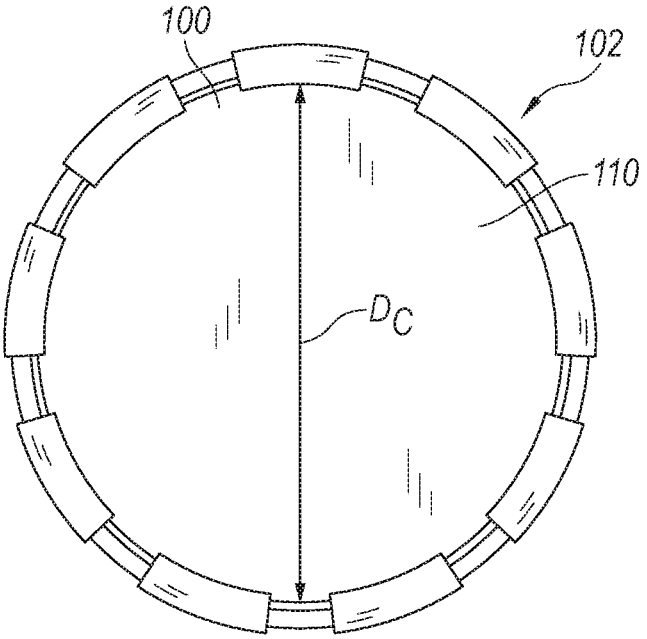
FIG. 8 is a side view of the dumbbell head cover in a contracted configuration for holding a head of a dumbbell in accordance with one embodiment.

FIG. 8 is a side view of the weight device in a contracted or installed configuration in accordance with one embodiment. Referring to FIGS. 7 and 8, a ratio of a diameter $D_E$ (FIG. 7) of opening 173 of the head cover 102 in the fully expandable configuration to a diameter $D_C$ (FIG. 8) of the head cover 102 (e.g., the section along the side of the head 110) in the contracted configuration can be equal to or greater than 1.1, 1.2, 1.25, 1.3, 1.4, 1.5, or another suitable ratio. In some embodiments, a ratio of the diameter $D_E$ when the head cover 102 is fully expanded to the diameter $D_C$ when the head cover 102 is fully contracted or in an unrestrained configuration (e.g., when removed from the head 110) can be in a range of about 1.2, 1.25, 1.3, 1.35, 1.4, 1.45, 1.5, 1.55, 1.6, 2, 3, or other suitable ratio. The unrestrained fully contracted configuration can be significantly smaller than the dumbbell head to ensure that sufficient compressive forces are applied by the head cover 102 to the dumbbell.

Figure 9:
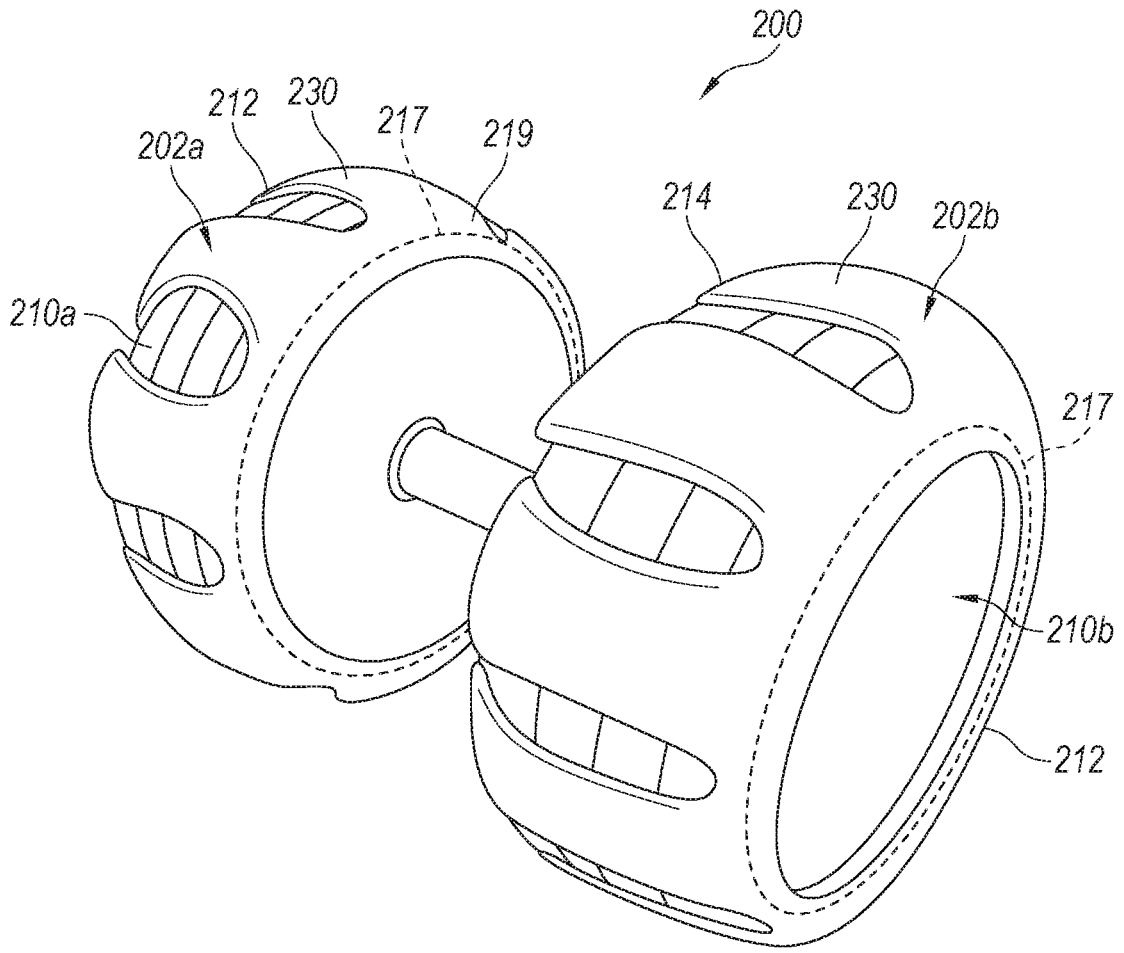
FIG. 9 is an isometric view of a weight system installed on ends of a dumbbell in accordance with an embodiment of the technology.

FIG. 9 is an isometric view of a weight system installed on ends of a dumbbell 200 in accordance with an embodiment of the technology. The weight system includes universal weighted head covers 202*a*, 202*a* removably coupled to heads 210*a*, 210*b*, respectively. The head covers 202*a*, 202*b* (collectively "head covers 202") can each include a first self-cinching end portion 212, a second self-cinching end portion 214, and a flexible tubular portion 230. The relevant description of the weight systems of FIGS. 1-8 applies equally to the weight system of FIGS. 9-11. The description of the first and second self-cinching end portions 212, 214 applies equally to one another.

Figure 10:
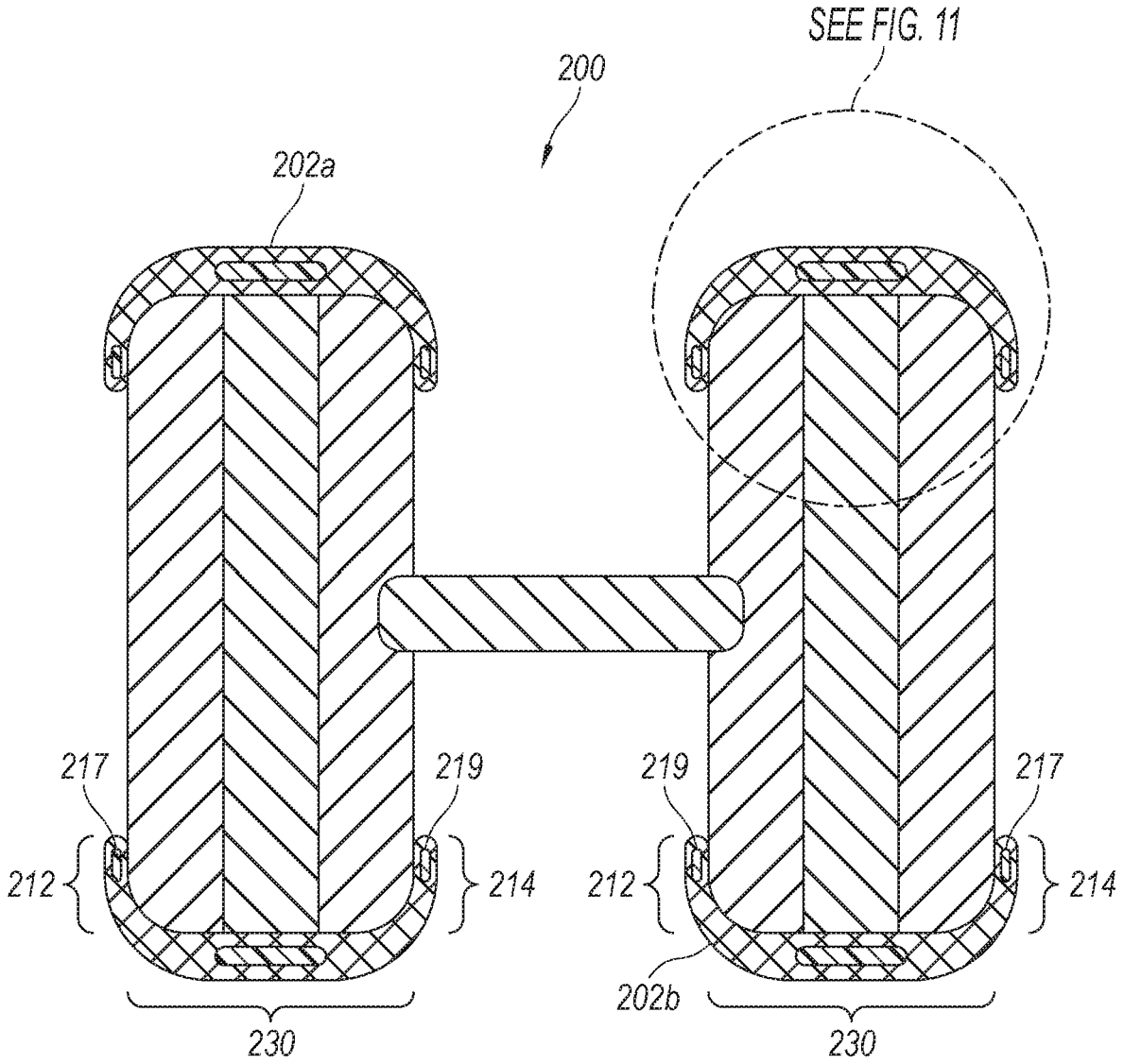
FIG. 10 is a cross-sectional view of the weight system and dumbbell of FIG. 9.

FIG. 10 is a cross-sectional view of the dumbbell 200 and the head covers 202. The end portion 212 can include a cinching or expanding element 217 ("element 217"), and the end portion 214 can include a cinching or expansion element 219 ("element 219"). In some embodiments, the elements 217, 219 can be positioned within the cover to avoid catching on workout equipment. In other embodiments, the elements 217, 219 can be woven through openings in the covering body such that sections of the elements 217, 219 are exposed.

Figure 11:
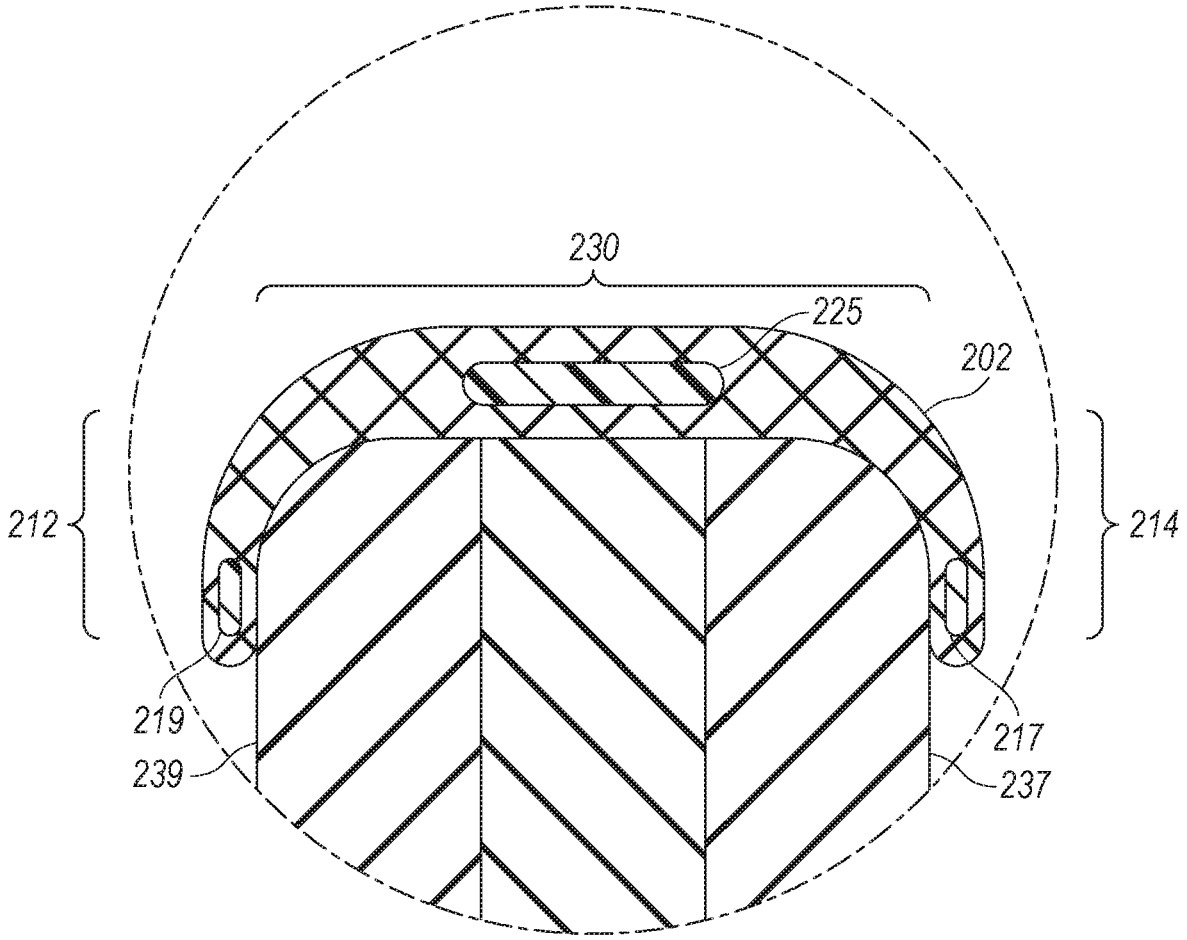
FIG. 11 is a detailed view of the weight system and dumbbell head.

FIG. 11 is a detailed cross-sectional view of the head cover 202. The cinching elements 117, 119 can be mono or multiplayer bands, straps, ties, laces, or other elements capable of providing cinching or contraction. In other embodiments, the cinching elements 117, 119 can be a bundle of elastic threads, elastic bands, or other elements that can withstand relatively high tensile forces. The user can pull on the elements 217, 219 to draw the head cover 202 about the dumbbell head and against faces 239, 237. The number and position of the cinching elements can be selected based on the desired holding capabilities.

The head cover 202 can include a weighted section 225 that includes a flexible material with a relatively large mass.

For example, the weighted section 225 can be an encapsulated weight or embedded pouch of sand, iron particles, or other mass capable of withstanding forces experienced during workouts. If the user drops the dumbbell from a distance of 1 foot, 2 feet, 3 feet, 4 feet, or higher, the covering and its components, including the weighted section 225, can remain intact. The compliant weighted section 225 and covering 102 can help absorb impact to reduce noise, inhibit damage to the dumbbell, or otherwise enhance the usage of the dumbbell.

In use, auxiliary weight systems can be used to progressively increase the weight of dumbbells to avoid plateauing, injuries, and so forth. A set of weight devices can be used to increase the weight of dumbbells for a highly customized workout. For example, a gym can provide enough weight devices to avoid large gaps in dumbbell weights. Because the weight devices are portable, the user can easily transport four head covers throughout the gym and can install them on pairs of dumbbells to provide customized weights. The head covers can be removed before placing dumbbells back on racks. In some embodiments, the tubular portions of the head covers disclosed herein can stretch to enhance fit. For example, head covers can be made of a continuous material capable of radially expanding and contracting. In segmented embodiments, the tubular portion can be made of a less compliant material because gaps between sections can radially expand to accommodate different size dumbbell heads. The gaps or slits can be dimensioned to allow desired accommodation by the head cover. Straps, belts, or other elements can be used to draw sections of portions of head covers inwardly. Fasteners, buckles, or other elements can be used to hold features (e.g., straps, belts, cinching features, etc.) at desired positions.

While particular aspects of the present subject matter described herein have been shown and described, it will be apparent to the reader that, based upon the teachings herein, changes and modifications can be made without departing from the subject matter described herein and its broader aspects, and, therefore, the appended claims are to encompass within their scope all such changes and modifications as are within the true spirit and scope of the subject matter described herein. While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A method, comprising:

installing a universal weighted head cover on a head of a dumbbell such that:

a first self-cinching end portion of the head cover is located on a first side of the head of the dumbbell;

a second self-cinching end portion of the head cover is located on a second side of the head of the dumbbell, wherein the first and second self-cinching end portions cooperate to captively hold the head of the dumbbell; and a flexible tubular portion of the head cover extends along the head of the dumbbell and between the first and second self-cinching end portions and including at least one weight with sufficient mass for altering weight lifting exercises performed using a dumbbell, wherein at least one of the first and second self-cinching end portions is expandable for removing the universal weighted head cover from a head of the dumbbell and for installing the universal weighted head cover on the head of the dumbbell.

2. The method of claim 1, wherein the flexible tubular portion is sufficiently compliant to snuggly hold the head of the dumbbell when the first self-cinching end portion is positioned along a first face of the head and the second self-cinching end portion is positioned along a second face of the head.

3. The method of claim 1, wherein the flexible tubular portion includes spaced apart weighted sections positionable about the head of the dumbbell.

4. The method of claim 1, wherein at least one of the first and second self-cinching end portions has an expanded configuration and a contracted configuration, the at least one of the first and second self-cinching end portions in the expanded configuration defines an opening with an expanded diameter larger than a diameter of the dumbbell head and in the contracted configuration the opening has a contracted diameter smaller than the diameter of the dumbbell head.

5. The method of claim 1, wherein the flexible tubular portion is configured to extend across a length of the head of the dumbbell when the first and second self-cinching end portions are cinched on opposite sides of the head.

6. The method of claim 1, wherein the flexible tubular portion further includes a plurality of weights configured to positioned about the periphery of the head of the dumbbell when the universal weighted head cover covers the head.

7. The method of claim 1, wherein the flexible tubular portion is sufficiently compliant to conform to a shape of the head of the dumbbell.

8. The method of claim 1, wherein the at least one weight includes a plurality of compliant weights configured to withstand an impact when the dumbbell is placed on a support surface.

9. The method of claim 1, wherein the first self-cinching end portion includes a plurality of elastic segments each coupled to respective adjacent sections of the tubular portion.

10. The method of claim 1, wherein the first self-cinching end portion includes an elastic band.

11. A method of applying a weighted head cover to a dumbbell, the weighted head cover comprises a plurality of weighted sections configured to extend between ends of a head of a dumbbell and at least one expandable member that interconnects a plurality of weighted sections, the method comprises expanding the at least one expandable member; and placing the weighted head cover over a dumbbell head of the dumbbell while the at least one expandable member is expanded, wherein the weighted head cover is positioned along the dumbbell head such that the at least one expandable member is capable of pulling the weighted sections against the outside of the dumbbell head.

12. The method of claim 11, wherein the at least one expandable member includes a first expandable member and a second expandable member, wherein the first and second expandable members are configured to be positioned at opposite sides of the head such that the weighted sections are spaced apart from one another about a circumference of the head.

13. The method of claim 11, wherein the weighted sections extend between ends of a head of the dumbbell and are substantially evenly spaced apart from one another while the at least one expandable member constricts the weight device about the head.

14. The method of claim 11, wherein the mass of the weight device is less than 5 $lb_m$.

15. The method of claim 11, wherein at least one expandable member includes a plurality of expandable members that cooperate to cinch opposing ends of the weight device about ends of the head.

16. The method of claim 11, wherein the at least one expandable member includes a first elastic band and a second elastic band.

17. The method of claim 16, wherein each of the first elastic and the second elastic band is positioned closer to a nearest end of head cover than a middle of the head cover.

18. The method of claim 11, wherein the weighted sections are spaced apart from one another about the dumbbell head when the weight device is installed.

19. The method of claim 11, wherein each of the weighted sections is sufficiently compliant to conform to the periphery of the dumbbell head.

20. The method of claim 11, wherein each of the weighted sections has a longitudinal axis generally aligned with a longitudinal axis of a dumbbell when the weight device is installed.

21. A system comprising:

a dumbbell; and a tubular dumbbell head cover including, a first expandable end located on a first side of a head of the dumbbell and in a contracted configuration for holding the weighted device on the head of the dumbbell, the first expandable end is movable to an expanded configuration for passing over the head of the dumbbell;

a second expandable end located on a second side of the head of the dumbbell; and a main body extending across the head of the dumbbell between the first and second ends that cooperate to hold the head of the dumbbell.

22. The system of claim 21, wherein a ratio of a diameter of the first expandable end in the expandable configuration to a diameter of the first expandable end in the contracted configuration is equal to or greater than 1.1.

23. The system of claim 21, wherein the main body includes a plurality of weighted sections configured to be circumferentially spaced apart from one another about the circumference of the head of the dumbbell.

24. The system of claim 21, wherein the mass of the tubular dumbbell head cover is less than 5 $lb_m$.

25. The system of claim 21, wherein the first and second expandable ends draw ends of the tubular dumbbell head cover inwardly past an outer periphery of the head.

26. The system of claim 21, wherein the main body is segmented.

27. The system claim 21, wherein the first and second expandable ends are positioned radially inwardly of the outer periphery of the head of the dumbbell when the tubular dumbbell head cover is installed.

28. The system of claim 21, wherein the at least one weight includes a plurality of weighted sections spaced apart from one another circumferentially about the dumbbell head when the tubular head cover is installed.

* * * * *